US009546060B2

(12) United States Patent
Tashiro

(10) Patent No.: US 9,546,060 B2
(45) Date of Patent: Jan. 17, 2017

(54) BEARING MEMBER, SHEET CONVEYING DEVICE AND IMAGE FORMING APPARATUS

(71) Applicant: KYOCERA Document Solutions Inc., Osaka (JP)

(72) Inventor: Yoshiaki Tashiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/874,973

(22) Filed: Oct. 5, 2015

(65) Prior Publication Data

US 2016/0096697 A1 Apr. 7, 2016

(30) Foreign Application Priority Data

Oct. 6, 2014 (JP) ..... 2014-205632

(51) Int. Cl.
*B65H 5/02* (2006.01)
*B65H 5/06* (2006.01)

(52) U.S. Cl.
CPC ..... *B65H 5/068* (2013.01); *B65H 2402/52* (2013.01); *B65H 2404/1431* (2013.01); *B65H 2404/1451* (2013.01); *B65H 2404/152* (2013.01); *B65H 2404/17* (2013.01); *B65H 2601/521* (2013.01)

(58) Field of Classification Search
CPC ..... B65H 5/06; B65H 5/062; B65H 2404/14; B65H 2401/143; B65H 2515/34; B65H 5/02; B65H 2404/144; B65H 2404/1451; B65H 29/06; B65H 29/12; B65H 29/125; B65H 29/14; B65H 29/145; B65H 29/20; B65H 29/22; B65H 29/243
USPC ..... 271/272–274, 314
See application file for complete search history.

(56) References Cited

U.S. PATENT DOCUMENTS

| | | | | |
|---|---|---|---|---|
| 8,490,969 | B2 * | 7/2013 | Sawamura et al. | 271/274 |
| 9,051,121 | B2 * | 6/2015 | Nagao | |
| 2014/0191469 | A1 * | 7/2014 | Tamura | 271/272 |

FOREIGN PATENT DOCUMENTS

| | | | |
|---|---|---|---|
| JP | 2003-160256 | A | 6/2003 |
| JP | 2009-227437 | A | 10/2009 |

* cited by examiner

*Primary Examiner* — Thomas Morrison
(74) *Attorney, Agent, or Firm* — Studebaker & Brackett PC

(57) ABSTRACT

A sheet conveying device includes a driving roller, a driven roller and a pair of bearing members. The pair of bearing members is configured to rotatably support both ends of a rotating shaft of the driven roller. The bearing member has a supporting part and a pressing part. The supporting part is formed by winding an end portion on one side of a wire rod in a spiral shape. The supporting part has a shaft hole through which one end of the rotating shaft can be inserted. The pressing part is formed by winding an end portion on the other side of the wire rod in a spiral shape in an orthogonal direction to the rotating shaft. The pressing part is disposed so as to press the supporting part in a direction in which the driven roller comes into pressure contact with the outer face of the driving roller.

6 Claims, 5 Drawing Sheets

BEARING MEMBER, SHEET CONVEYING DEVICE AND IMAGE FORMING APPARATUS

INCORPORATION BY REFERENCE

This application is based on and claims the benefit of priority from Japanese Patent application No. 2014-205632 filed on Oct. 6, 2014, the entire contents of which are incorporated herein by reference.

BACKGROUND

The present disclosure relates to a bearing member which supports a driven roller, a sheet conveying device which conveys a sheet along a conveying path and an image forming apparatus provided with this sheet conveying device.

In an image forming apparatus, a sheet fed from a sheet feeding cartridge to a conveying path or a sheet fed to an inversion path for duplex printing is conveyed to a downstream side of the conveying path by a sheet conveying device. Such a sheet conveying device is generally provided with a driving roller rotationally driving and a driven roller which comes into pressure contact with an outer circumferential face of the driving roller, and is configured to convey the sheet between the driving roller and the driven roller.

In the conveying device of such a configuration, the driven roller is supported so as to come into pressure contact with the driving roller at a predetermined pressure. In order to support the driven roller so as to come into pressure contact with the driving roller, there may be a case in which a rotating shaft of the driven roller is made of metal and the rotating shaft is biased toward the driving roller by an elastic member such as a coil spring. On the other hand, in a sheet conveying device of an image forming apparatus of a low speed specification, there may be a case in which a rotating shaft of a driven roller is made of resin, and this rotating shaft is biased toward the driving roller by an elastic member such as a linear spring.

In addition, a bearing member using a torsion coil spring as an elastic member may be sometimes used. In this bearing member, one end part of the torsion coil spring is tightly wound in a spiral shape to form a winding part into which the rotating shaft of the driven roller is rotatably supported and, therefore, the driven roller comes into pressure contact with the driving roller by a biasing force of the torsion coil spring.

However, in the case of the rotating shaft made of metal, there is a problem that abnormal noise is easy to be generated. As a solution to this problem, there may be a case in which a countermeasure to apply a grease to the surface of the rotating shaft or to apply a high sliding coating on the surface of the rotating shaft may be taken. Alternatively, there may be a case in which the rotating shaft is formed with a plane portion for functioning as a rotation stop of the rotating shaft. Although a variety of countermeasures have been thus taken, in any case, higher costs are unavoidable.

Also, in the case of the rotating shaft made of resin, although there is no problem in the image forming apparatus of a low speed specification, when applied to an image forming apparatus of a high speed specification, since abrasion of the rotating shaft due to contact with a pressing member is severe, the rotating shaft is deteriorated in durability.

In addition, in the case of the bearing member using the torsion coil spring, at attaching the bearing member, since it is necessary to position the bearing member at two positions, that is, at the coil part of the torsion coil spring and at an opposite end part to the winding part, there is a problem that attachment work of the bearing member is complicated.

SUMMARY

In accordance with an embodiment of the present disclosure, a sheet conveying device includes a driving roller, a driven roller and a pair of bearing members. The driving roller drives rotationally. The driven roller is configured to come into pressure contact with an outer circumferential face of the driving roller and to be rotationally driven. The pair of bearing members is configured to rotatably support both ends of a rotating shaft of the driven roller such that the driven roller can come into pressure contact with the driving roller. Each of the pair of bearing members has a supporting part and a pressing part. The supporting part is formed by winding an end portion on one side of a wire rod in a spiral shape. The supporting part has a shaft hole through which one end of the rotating shaft can be inserted. The pressing part is formed by winding an end portion on the other side of the wire rod in a spiral shape in an orthogonal direction to the rotating shaft. The pressing part is disposed so as to press the supporting part in a direction in which the driven roller comes into pressure contact with the outer circumferential face of the driving roller.

In accordance with an embodiment of the present disclosure, an image forming apparatus includes the above described sheet feeding device.

In accordance with an embodiment of the present disclosure, a bearing member configured to rotatably support a rotating shaft of a driven roller such that the driven roller can come into pressure contact with a driving roller and then be rotationally driven includes a supporting part and a pressing part. The supporting part is formed by winding an end portion on one side of a wire rod in a spiral shape. The supporting part has a shaft hole through which the rotating shaft can be inserted. The pressing part is formed by winding an end portion on the other side of the wire rod in a spiral shape in an orthogonal direction to the rotating shaft.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, a sheet conveying device and an image forming apparatus according to the present discloser be described.

Figure 1:
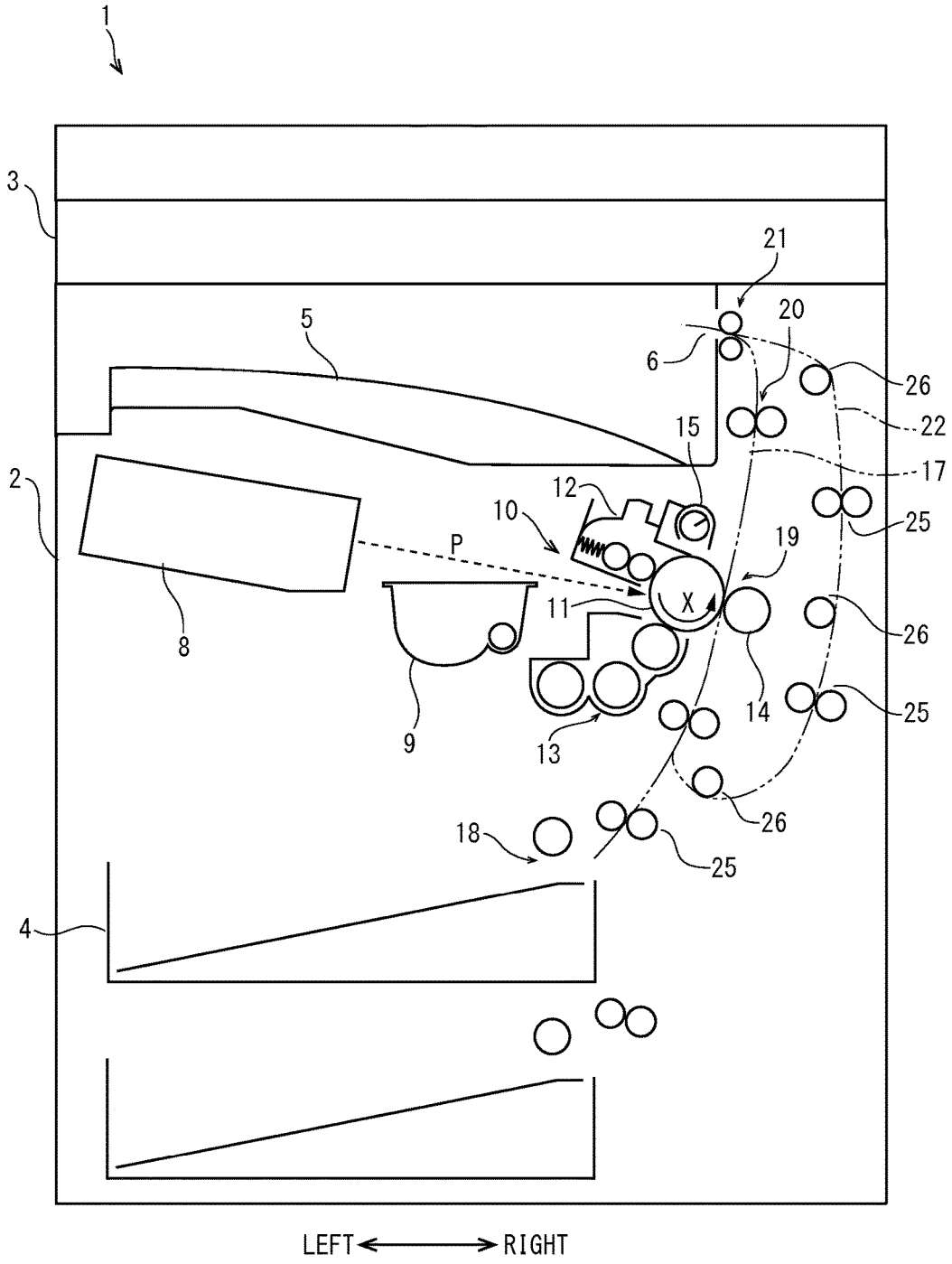
FIG. 1 is a front view schematically showing an internal structure of a printer according to an embodiment of the present disclosure.

First, with reference to FIG. 1, an entire structure of a printer (an image forming apparatus) 1 will be described. FIG. 1 is a sectional view schematically showing an internal structure of the printer according to an embodiment of the present disclosure. Hereinafter, a front side in FIG. 1 indicates a front side of the printer 1 and left and right directions are described on the basis of a direction when the image forming apparatus 1 is viewed from the front side.

As shown in FIG. 1, the printer 1 includes an apparatus main body 2 provided with an image reading part 3 on the upper end. In a lower part of the apparatus main body 2, a sheet feeding cartridge 4 storing a sheet (not shown) is housed. On the upper face of the apparatus main body 2, an ejected sheet tray 5 is provided and a sheet ejecting port 6 is formed on the right side of the ejected sheet tray 5.

Inside the apparatus maim body 2, an exposure device 8 consisting of laser scanning unit (LSU) is arranged under the ejected sheet tray 5. On the right side of the exposure device 8, a toner container 9 is arranged. On the right side of the toner container 9, an image forming part 10 is provided. In the image forming part 10, a photosensitive drum 11 as an image carrier is rotatably provided. Around the photosensitive drum 11, a charging device 12, a development device 13, a transfer roller 14 and a cleaning device 15 are arranged in order along a rotating direction (refer to an arrow X in FIG. 1) of the photosensitive drum 11.

Inside the apparatus main body 2, a conveying path 17 extending from the sheet feeding cartridge 4 toward the sheet ejecting port 6 is formed. Along the conveying path 17, a sheet feeding part 18, a transferring part 19 formed between the photosensitive drum 11 and the transfer roller 14, a fixing device 20 and a sheet ejecting device 21 are provided in order from the upstream side of the sheet conveying path 17. The conveying path 17 is branched into an inversion path 22 at a branched portion between the fixing device 20 and the sheet ejecting device 21. The inversion path 22 is joined with the conveying path 17 at a joined portion between the sheet feeding part 18 and the transferring part 19. Between the sheet feeding part 18 and the transferring part 19 along the conveying path 17, a sheet conveying device 25 configured to convey the sheet from the sheet feeding part 18 to the transferring part 19 is arranged. The sheet conveying devices 25 are also arranged along the inversion path 22 at predetermined intervals so as to convey the sheet from the branched portion to the joined portion. Along the inversion path 22, guide rollers 26 are also provided so as to reduce a friction applied on the sheet.

Next, an image forming operation of the printer 1 having the above structure will be described.

When image data is read by the image reading part 3 or image date is input from a computer or the like connected to the printer 1, image forming operation is carried out as follows.

First, the surface of the photosensitive drum 11 is electric-charged by the charging device 12. Then, photographic exposure corresponding to the image data on the photosensitive drum 11 is carried out by a laser light (refer to a two-dot chain line p in FIG. 1) from the exposure device 8, thereby forming an electrostatic latent image on the surface of the photosensitive drum 11. Subsequently, the electrostatic latent image is developed into a toner image with a toner (a developer) supplied from the toner container 9 by the development device 13.

On the other hand, the sheet fed from the sheet feeding cartridge 4 by the sheet feeding part 18 is conveyed to the transferring part 19 by the sheet conveying device 25 in a suitable timing for the above-mentioned image forming operation, and then, the toner image on the photosensitive drum 11 is transferred onto the sheet in the transferring part 19. The sheet with the transferred toner image is conveyed to the downstream side in the conveying path 17 and goes into the fixing device 20, and then, the toner image is fixed on the sheet at the fixing device 20. The sheet with the fixed toner image is ejected from the sheet ejection port 6 on the ejected sheet tray 5 by the sheet ejecting device 21. The toner remained on the photosensitive drum 11 is collected by the cleaning device 15.

When duplex printing is carried out, the sheet in which the toner image has been formed on one face after passing the fixing device 20 is conveyed above the ejected sheet tray 5 through the sheet ejecting port 6 by the sheet ejecting device 21. When the rear end of the sheet is reached at a predetermined position, the sheet ejecting device 21 reverse the conveying direction of the sheet so as to convey the sheet into the inversion path 22. The sheet is conveyed along the inversion path 22 by the sheet conveying devices 25 and then enters the conveying path 17 at the joined portion on the upstream side from the transferring part 19. On the other hand, toner image corresponding to image date to be printed on the other face of the sheet is formed on the surface of the photosensitive drum 11. After transferring the toner image formed on the surface of the photosensitive drum 11 on the other face of the sheet at the transferring part 19, the toner image is fixed on the sheet by the fixing device 20. The sheet on which both faces the toner image are fixed is ejected on the ejected sheet tray 5 through the sheet ejecting port 6 by the sheet ejecting device 21.

Figure 2:
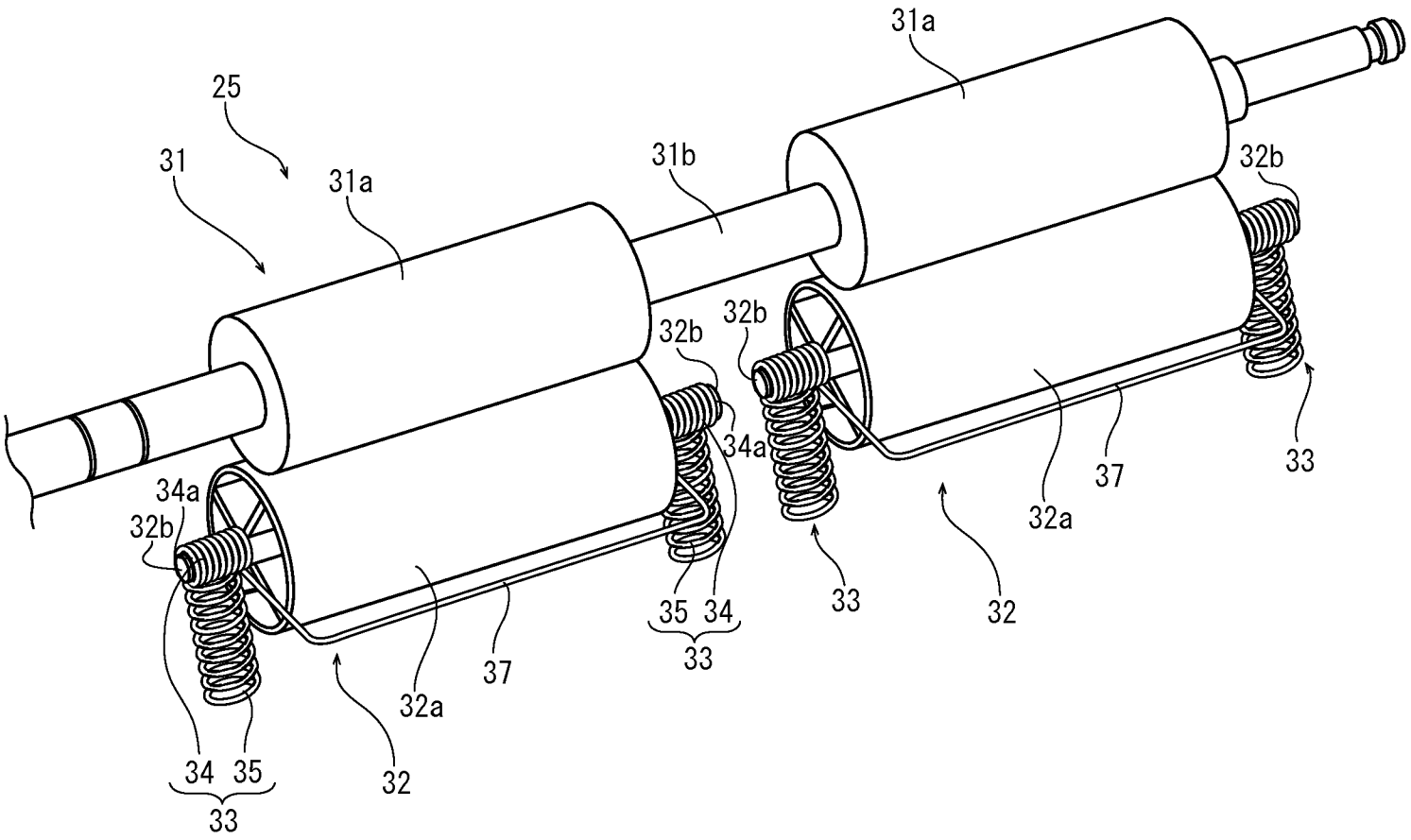
FIG. 2 is a perspective view showing a sheet conveying device according to a first embodiment of the present disclosure.

Next, with reference to FIG. 2, the sheet conveying device 25 according to a first embodiment of the present disclosure will be described. FIG. 2 is a perspective view showing the sheet conveying device.

The sheet conveying device 25 includes: a driving roller 31 rotationally driving; a driven roller 32 which comes into pressure contact with the driving roller 31 and is rotationally driven; and a pair of bearing members 33 which support the driven roller 32 rotatably so as to press it against the driving roller 31.

The driving roller 31 has a plurality of roller body parts 31*a* and a rotating shaft 31*b*. The rotating shaft 31*b* is rotatably supported at a predetermined position of the apparatus main body 2 and is connected to a driving source (not shown). When the rotating shaft 31*b* is rotated by the driving source, the roller body parts 31*a* rotate together with the rotating shaft 31*b* in the sheet conveying direction.

The driven roller 32 has a roller body part 32*a* and a rotating shaft 32*b*. The roller body part 32*a* and the rotating shaft 32*b* each are made of a resin material having a high sliding property and a high abrasion resistance (for example, POM (polyoxymethylene) resin). The driven roller 32 is supported on the apparatus main body 2 by the pair of bearing members 33 so as to correspond to each roller body part 31*a* of the driving roller 31.

Each of the pair of bearing members 33 is formed of a wire rod having an elasticity (for example, a hard steel wire or a piano wire, a stainless steel wire), and has: a supporting part 34 which rotatably supports one end of the rotating shaft 32*b* of the driven roller 32; and a pressing part 35 which presses the supporting part 34.

The supporting part 34 is formed by tightly winding an end portion on one side of the wire rod in a spiral shape and has a shaft hole 34*a* through which the rotating shaft 32*b* of the driven roller 32 can be inserted. In detail, adjacent wound portions formed by winding the wire rod into one turn come into contact with each other in an axial direction of the shaft hole 34*a*. The supporting part 34 has a length substantially equal to a length of one end of the rotating shaft 32*b* of the driven roller 32.

The pressing part 35 is formed by winding an end portion on the other side of the wire rod at intervals in a spiral shape into a shape of a coil spring. In detail, adjacent wound portions formed by winding the wire rod into one turn are separated away each other at predetermined intervals so as to have an elasticity in the length direction.

The pressing part 35 is positioned with respect to the supporting part 34 such that the length direction, that is, the pressing direction is orthogonal to the axial direction of the shaft hole 34*a* of the supporting part 34. One end of the pressing part 35 comes into contact with the center portion of the outer circumference of the supporting part 34 in the length direction.

The bearing member 33 which supports one end of the rotating shaft 32*b* and the bearing member 33 which supports the other end of the rotating shaft 32*b* are coupled with each other by a coupling part 37. The coupling part 37 is also formed of the wire rod. For example, an end of the wire rod in the supporting part 34 of one bearing member 33 and an end of the wire rod in the supporting part 34 of the other bearing member 33 are coupled with each other by the coupling part 37. Alternatively, two bearing members 33 and the coupling part 37 may be formed of one wire rod. In this case, one end of the wire rod is wound in a coil shape to form the pressing part 35 and the supporting part 34 continuously to the pressing part 35. On the other hand, the other end of the wire rod is wound in a coil shape to form the pressing part 35 and the supporting part 34 continuously to the pressing part 35. Afterwards, the center of the wire rod is bent in a U-shape, whereby the supporting parts 34 of the respective bearing members 33 are coupled with each other by the coupling part 37. Incidentally, the coupling part 37 may be bent in an arc shape or the like.

In order to support the driven roller 32 rotatably by the pair of bearing members 33 having the configuration as mentioned above, first, both ends of the rotating shaft 32*b* of the driven roller 32 are respectively inserted into the shaft hole 34*a* of the supporting part 34 of the bearing member 33. In this manner, the pressing direction of the pressing part 35 of the bearing member 33 is coincident with a direction orthogonal to the axial direction of the rotating shaft 32*b* of the driven roller 32. Afterwards, with the roller body part 32*a* of the driven roller 32 corresponded to the roller body part 31*a* of the driving roller 31, each of the bearing members 33 is positioned such that the pressing direction of the pressing part 35 is coincident with a direction in which the driven roller 32 is pressed against the outer circumferential face of the driving roller 31, and then is attached to the apparatus main body 2. Additionally, the pressing part 35 of the bearing member 33 may be engaged with a boss or the like which is erected at a predetermined position of the apparatus main body 2. In this manner, the pressing part 35 is compressed so as to have a desired pressing force, and by this pressing force, the driven roller 32 comes into pressure contact with the driving roller 31. Incidentally, the number of windings or winding diameter of the pressing part 35 of the bearing member 33 is set such that, in the compressed posture attached to the apparatus main body 2, the roller body part 32*a* of the driven roller 32 comes into pressure contact with the roller body part 31*a* of the driving roller 31 at a desired pressure.

The sheet conveyed to the conveying path 17 or the inversion path 22 passes between the driving roller 31 and the driven roller 32 of the sheet conveying device 25 and is conveyed to the downstream side of the conveying path 17 or the inversion path 22 by rotation of the driving roller 31.

As has been described above, in the sheet conveying device 25 according to the embodiment, since a resin material can be used as a material for the driven roller 32 and one wire rod made of metal can be used as a material for the pair of bearing members 33, the sheet conveying device 25 can have a simple and inexpensive configuration. Further, since the outer circumferential face of the rotating shaft 32*b* of the driven roller 32 comes into point contact with the outer circumferential face of the wound wire rod in the supporting part 34 of the bearing member 33, a contact area between the rotating shaft 32*b* and the supporting part 34 becomes small and a sliding resistance during the rotation of the rotating shaft 32*b* is thereby reduced. Therefore, generation of abnormal noise or abrasion of the rotating shaft 32*b* can be prevented and thus the sheet conveying device as mentioned above is applicable to the printer 1 of a high speed specification.

In addition, since the supporting part 34 rotatably supporting the rotating shaft 32*b* of the driven roller 32 is pressed by the pressing part 35 formed in a coil spring shape, when each of the bearing members 33 is attached to the apparatus main body 2, it is sufficient to position the bearing member 33 such that the pressing direction of the pressing part 35 is coincident with a pressure contact direction of the driven roller 32. In a case where the supporting part 34 may be formed at one end part of the torsion coil spring, since it is necessary to position the torsion coil spring at two positions, that is, at the coil part and at an opposite end part to the supporting part 34, with respect to the apparatus main body 2, an attachment work to the apparatus main body 2 is complicated. However, in the embodiment, since it is merely necessary to position the bearing member 33 at one position, that is, at the pressing part 35, the bearing member 33 can be attached to the apparatus main body 2 with a simple work.

Further, since the bearing members 33 that rotatably supports both ends of the rotating shaft 32*b* of the driven roller 32 are coupled with each other by the coupling part 37, handling or assembling of the pair of bearing members 33 is easily carried out.

Furthermore, in the embodiment, since the driven roller 32 and the bearing member 33 come into rotational contact with each other merely between the rotating shaft 32*b* of the driven roller 32 and the supporting part 34 of the bearing member 33, a portion at which abnormal noise is easily generated is limitative. Therefore, if abnormal noise is generated, etc., a countermeasure, for example, applying a grease between the rotating shaft 32*b* of the driven roller 32 and the supporting part 34 of the bearing member 33 or adjusting the diameter of the shaft hole 34*a* of the supporting part 34 can be easily taken.

Although the embodiment is described as to the case in which the supporting part 34 and the pressing part 35 are formed of one wire rod, the supporting part 34 and the pressing part 35 may be formed independently by separate wire rod and then the pressing part 35 may be secured to the outer circumference face of the supporting part 34 by an adhesive or the like.

Figure 3:
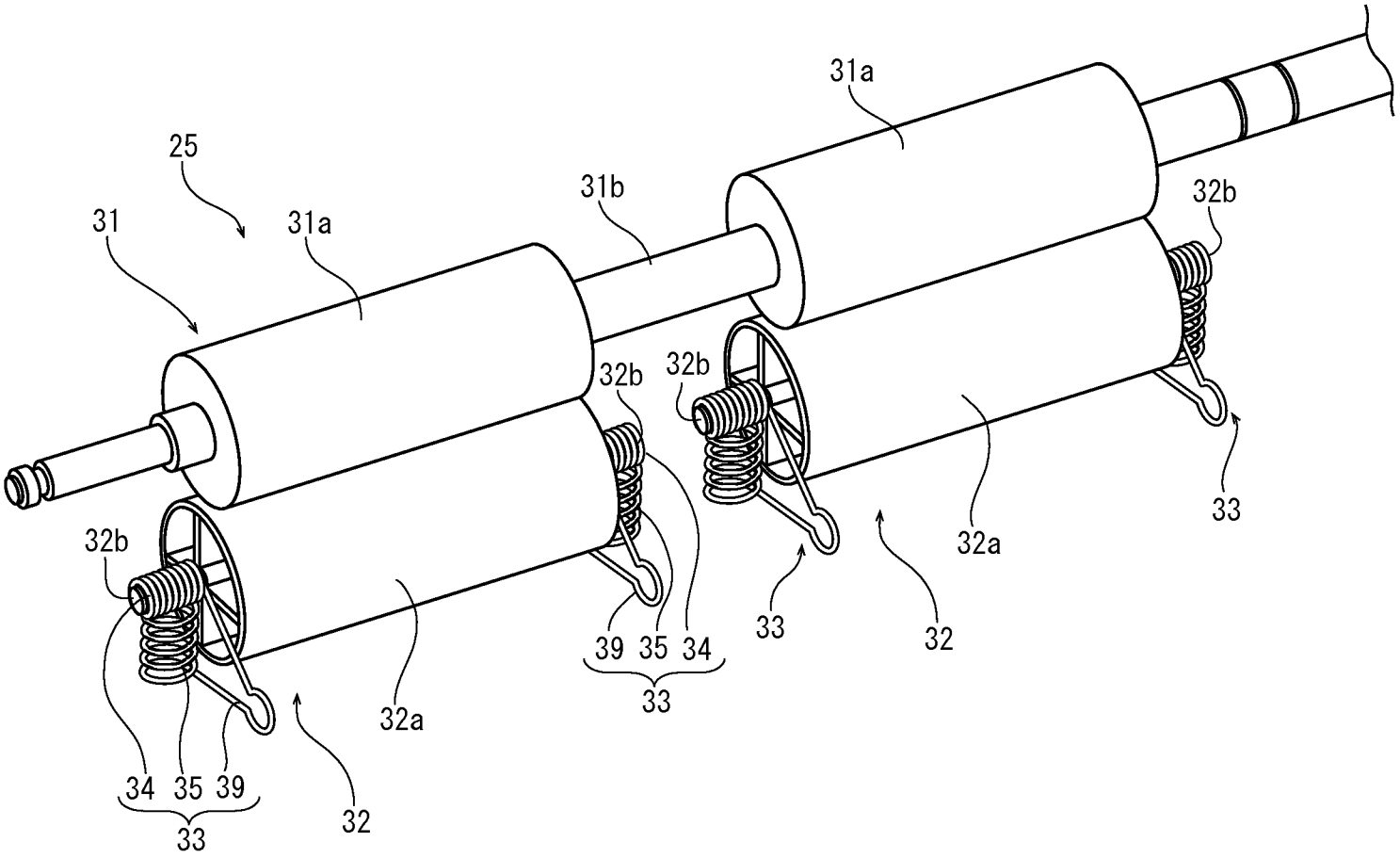
FIG. 3 is a perspective view showing a sheet conveying device according to a second embodiment of the present disclosure.
Figure 4:
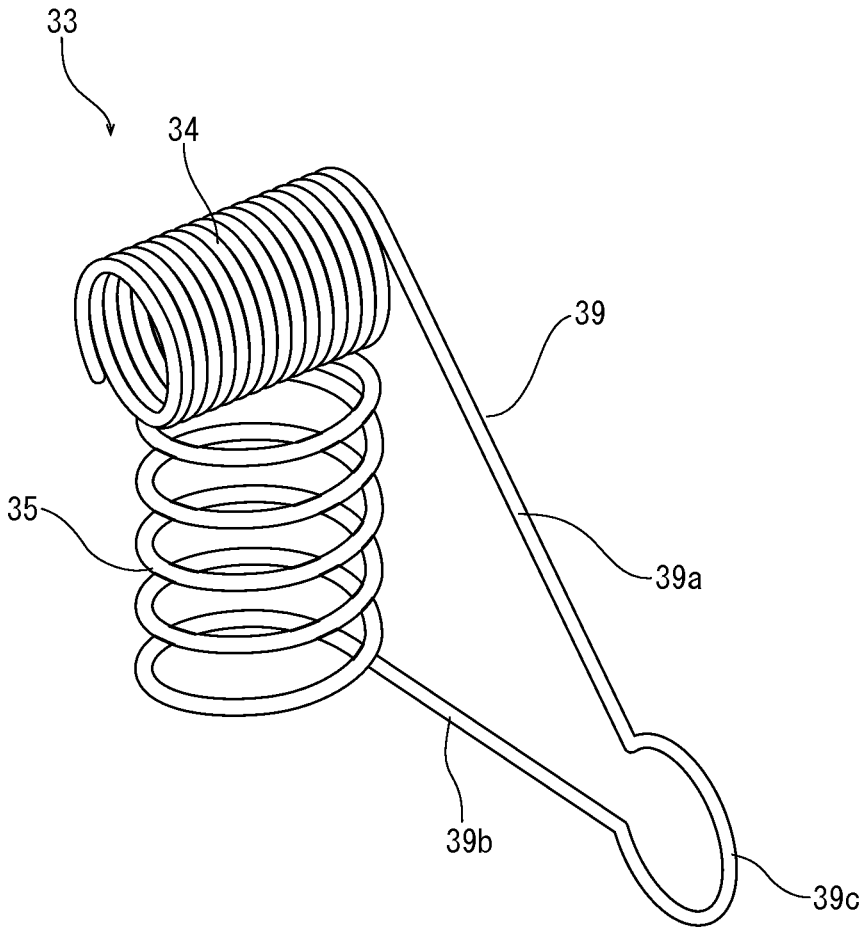
FIG. 4 is a perspective view showing a bearing member in the sheet conveying device according to the second embodiment of the present disclosure.
Figure 5:
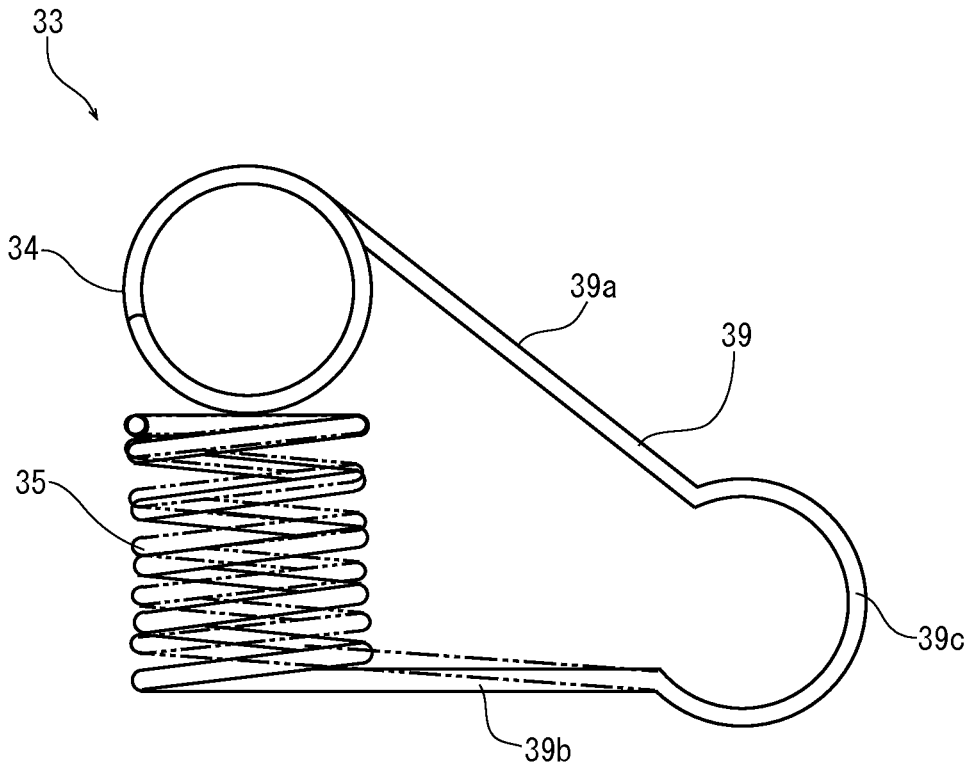
FIG. 5 is a front view showing a natural posture and a compressed posture of the bearing member in the sheet conveying device according to the second embodiment of the present disclosure.

Next, with reference to FIG. 3 to FIG. 5, a sheet conveying device 25 according to a second embodiment of the present disclosure will be described. FIG. 3 is a perspective view showing the sheet conveying device; FIG. 4 is a perspective view of a bearing member; and FIG. 5 is a front view showing a compressed state of the bearing member. Incidentally, parts, portions and members having the same configurations as those of the first embodiment are indicated by the same reference numerals as those of the first embodiment, and a detail description is omitted.

In the sheet conveying device 25 according to the second embodiment, as shown in FIG. 3, each of the pair of bearing members 33 has: a supporting part 34 which supports rotatably one end of the rotating shaft 32*b* of the driven roller 32; the pressing part 35 which presses the supporting part 34; and a connecting part 39 which connects the supporting part 34 and the pressing part 35.

The connecting part 39, as shown in FIG. 4, has: a first arm portion 39*a* extending linearly from one end of the supporting part 34; a second arm portion 39*b* extending linearly from the lower end of the pressing part 35; and a joint portion 39*c* formed in a three quarter arc shape and coupling the first arm portion 39*a* and the second arm portion 39*b*. The first arm portion 39*a* and the second arm portion 39*b* are turnably coupled by the joint portion 39*c* at about 45 degrees.

The number of windings or winding diameter of the pressing part 35 of the bearing member 33 is set such that, in the compressed posture attached to the apparatus main body 2, the roller body part 32*a* of the driven roller 32 comes into pressure contact with the roller body part 31*a* of the driving roller 31 at a desired pressure. In order to ensure that the driven roller 32 comes into pressure contact with the driving roller 31 only by the pressing force of the pressing part 35, it is necessary to prevent a spring load (a burden) from being applied to the driven roller 32 from the connecting part 39 accompanying with the compression of the pressing part 35. Thus, the joint portion 39*c* of the connecting part 39 is formed such that the first arm portion 39*a* and the second arm portion 39*b* are connected independently swingable. Namely, if the pressing part 35 is compressed from the natural posture as indicated by the solid line of FIG. 5 to the compressed posture as indicated by the double-dotted chain line of FIG. 5, the second arm portion 39*b* and the first arm portion 39*a* turn around the joint portion 39*c* so as to be close to each other; and however, a pressing force is not applied to the supporting part 34 from the connecting part 39 by this turning.

When the driven roller 32 is rotatably supported by the pair of bearing members 33 having the configuration as mentioned above, after corresponding the roller body part 32*a* of the driven roller 32 to the roller body part 31*a* of the driving roller 31, each of the bearing members 33 is positioned such that the pressing direction of the pressing part 35 is coincident with a direction in which the driven roller 32 is pressed against the outer circumferential face of the driving roller 31, and then the lower end of the pressing part 35 (the opposite end to the supporting part 34) is attached at a predetermined position of the apparatus main body 2. In this manner, the pressing part 35 is compressed so as to have a desired pressing force, and by this pressing force, the driven roller 32 comes into pressure contact with the driving roller 31. Incidentally, at the connecting part 39 of the bearing member 33, although the first arm portion 39*a* and the second arm portion 39*b* are displaced so as to be close to each other, a load (a burden) accompanied with this displacement is not applied to the supporting part 34.

In the bearing members 33 of this example as well, since it is sufficient to position the pressing part 35 at a predetermined position, the attachment work of the bearing member 33 can be easily carried out. In addition, since the supporting part 34 and the pressing part 35 are spaced from each other via the connecting part 39, the pair of bearing members 33 can be formed easily using one wire rod.

In addition, the pair of bearing members 33 may be coupled by the coupling part. In this case, if the pair of bearing members 33 are disposed with the connecting part 39 outside, the pair of bearing members 33 can be coupled by the coupling part 37 similar to that of the first embodiment.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A sheet conveying device comprising:

a driving roller rotationally driving;

a driven roller configured to come into pressure contact with an outer circumferential face of the driving roller and to be rotationally driven; and a pair of bearing members configured to rotatably support both ends of a rotating shaft of the driven roller such that the driven roller can come into pressure contact with the driving roller, wherein each of the pair of bearing members includes:

a supporting part formed by winding an end portion on one side of a wire rod in a spiral shape, the supporting part having a shaft hole through which one end of the rotating shaft can be inserted;

a pressing part formed by winding an end portion on the other side of the wire rod in a spiral shape in an orthogonal direction to the rotating shaft, and the pressing part is disposed so as to press the supporting part in a direction in which the driven roller comes into pressure contact with the outer circumferential face of the driving roller; and a connecting part including a first arm portion extending linearly from one end of the supporting part; a second arm portion extending linearly from one end of the pressing part; and a joint portion formed in a shape of an arc and configured to couple the first arm portion and the second arm portion, and the first arm portion and the second arm portion are independently swingable around the joint portion.

2. The sheet conveying device according to claim 1, wherein the pair of bearing members further includes a coupling part configured to couple the supporting part of each of the pair of the bearing members.

3. The sheet conveying device according to claim 1, wherein an angle between the first arm portion and the second arm portion around the joint portion is about 45 degrees.

4. The sheet conveying device according to claim 1, wherein the pressing part is configured to press a center portion of the supporting part in a length direction.

5. An image forming apparatus comprising the sheet conveying device according to claim 1.

6. A bearing member configured to rotatably support a rotating shaft of a driven roller such that the driven roller can come into pressure contact with a driving roller and then be rotationally driven comprising:

a supporting part formed by winding an end portion on one side of a wire rod in a spiral shape, the supporting part having a shaft hole through which the rotating shaft can be inserted;

a pressing part formed by winding an end portion on the other side of the wire rod in a spiral shape in an orthogonal direction to the rotating shaft ; and a connecting part including a first arm portion extending linearly from one end of the supporting part; a second arm portion extending linearly from one end of the pressing part; and a joint portion formed in a shape of an arc and configured to couple the first arm portion and the second arm portion, and the first arm portion and the second arm portion are independently swingable around the joint portion.

* * * * *